US008066310B2

(12) United States Patent
O'Hare

(10) Patent No.: US 8,066,310 B2
(45) Date of Patent: Nov. 29, 2011

(54) ANIMAL WASTE REMOVAL DEVICE

(76) Inventor: Michael J. O'Hare, Nutley, NJ (US)

( * ) Notice: Subject to any disclaimer, the term of this patent is extended or adjusted under 35 U.S.C. 154(b) by 423 days.

(21) Appl. No.: 12/244,749

(22) Filed: Oct. 2, 2008

(65) Prior Publication Data

US 2009/0179441 A1 Jul. 16, 2009

Related U.S. Application Data

(60) Provisional application No. 60/976,995, filed on Oct. 2, 2007.

(51) Int. Cl.
*A01K 29/00* (2006.01)
*E01H 1/12* (2006.01)

(52) U.S. Cl. ..... 294/1.4

(58) Field of Classification Search ..... 294/1.3, 294/1.4, 1.5, 19.1, 100
See application file for complete search history.

(56) References Cited

U.S. PATENT DOCUMENTS

| | | | | |
|---|---|---|---|---|
| 3,819,220 | A * | 6/1974 | Bredt | 294/1.5 |
| 4,056,278 | A * | 11/1977 | Bau et al. | 294/1.4 |
| 4,466,647 | A * | 8/1984 | Spevak | 294/1.5 |
| 4,711,482 | A * | 12/1987 | Brown et al. | 294/19.1 |
| 4,819,977 | A * | 4/1989 | Cooper | 294/1.4 |
| 4,827,956 | A * | 5/1989 | Toot | 135/66 |
| 4,878,703 | A * | 11/1989 | Yoshioka | 294/1.5 |
| 4,995,661 | A | 2/1991 | Aurness et al. | |
| 5,380,054 | A | 1/1995 | Galvis | |
| 6,196,601 | B1 * | 3/2001 | Juntunen, Jr. | 294/1.4 |
| 6,925,791 | B2 | 8/2005 | Herndon | |
| 7,625,025 | B1 * | 12/2009 | Zahedi | 294/1.3 |
| 2004/0135386 | A1 * | 7/2004 | Pineda | 294/1.4 |

FOREIGN PATENT DOCUMENTS

KR 1020060090484 8/2007

* cited by examiner

*Primary Examiner* — Dean J Kramer
(74) *Attorney, Agent, or Firm* — West & Associates, A PC; Stuart J. West

(57) ABSTRACT

A device capable of procuring one or more objects from a surface, particularly the removal of pet waste from the ground or another surface. The device can allow a person to remove waste while standing or sitting in a comfortable position, thereby reducing or eliminating strain or injury. The device can be used with one hand and with minimal effort.

12 Claims, 11 Drawing Sheets

ANIMAL WASTE REMOVAL DEVICE

This application claims the benefit of U.S. Provisional Application No. 60/976,995, filed on Oct. 2, 2007.

BACKGROUND

1. Field of the Invention

The present disclosure relates to the field of pet care equipment, specifically a device for the removal of pet waste from the ground or another surface.

2. Background

Dog owners often enjoy taking their canines for walks outdoors, however the task of cleaning up the waste left behind by the dogs can be bothersome. A dog walker has to not only carry around several bags on each outing but must also pick up the dog's feces, a task that usually includes squatting or bending down, using a bag and one's hand to scoop up the waste, and simultaneously holding onto the dog's leash and making sure that he or she does not run away. Depending on the length of the walk this task may need to be completed several times. For some people with physical limitations, waste removal can be not only annoying but also difficult and/or painful.

In order to make the waste removal process easier, it is important to have a device that allows a person to remove waste while standing in a comfortable position. It is also important to have a device that is compact and easy to carry. Several dog waste removal devices are currently on the market. However, these devices require the use of both hands, are bulky and non-retractable, are inefficient, and/or are difficult to use.

What is needed is an efficient waste removal device that is compact and easy to carry, requires the use of only one hand with minimal effort, and can be used while standing.

DETAILED DESCRIPTION

Figure 1:
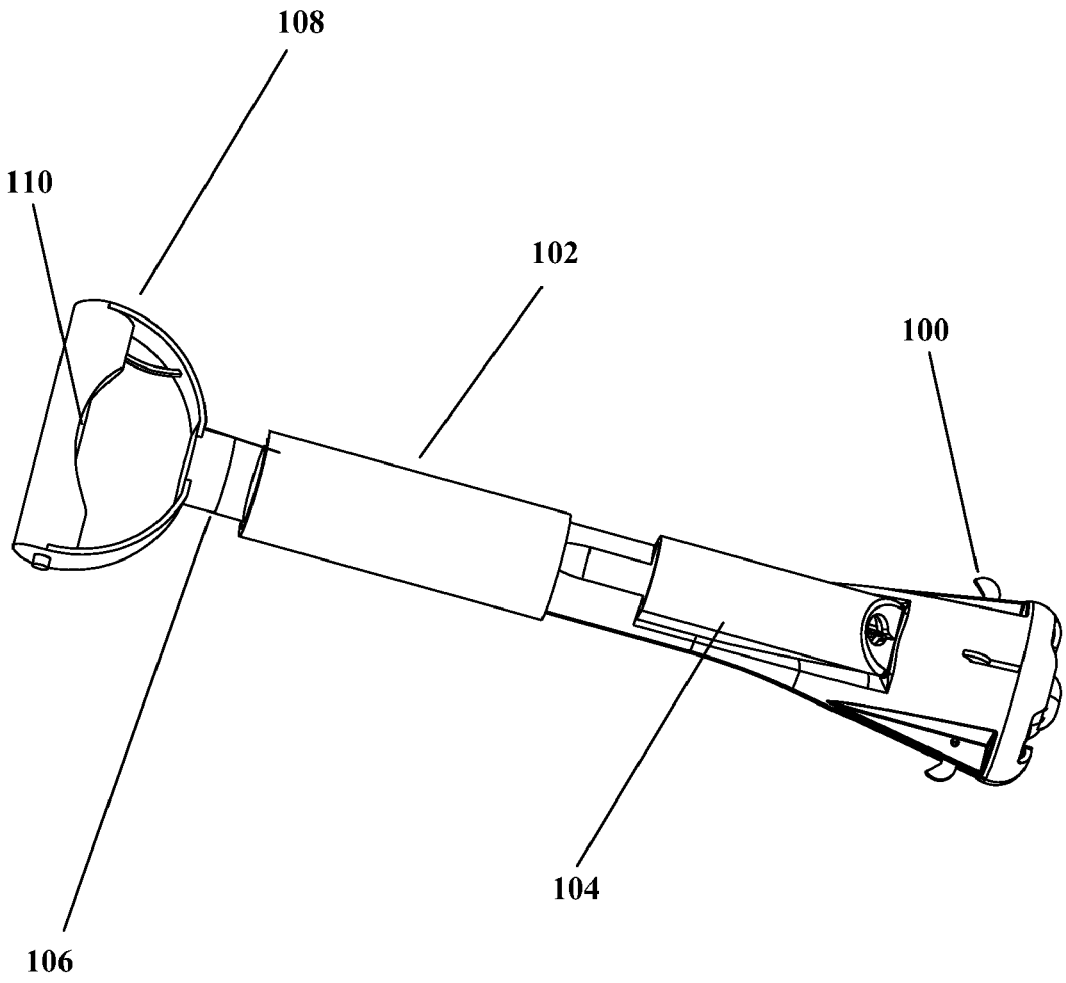
FIG. 1 depicts a perspective view of the present device in a fully retracted position.

FIG. 1 shows a perspective view of the present device 100 in a fully retracted position. A tubular telescope housing member 102 can house a plurality of tubular telescoping members 106, which can be in a nested configuration and substantially hidden when the present device 100 is in a fully retracted position, as shown in FIG. 1. Each of a plurality of tubular telescoping members 106 can have a proximal end and a distal end. As shown in FIG. 1, the proximal end of the circumferentially smallest member of a plurality of tubular telescoping members 106 can be connected to a handle member 108, and the distal end of a tubular telescope housing member 102 can be connected to a substantially tubular tine assembly housing member 104. In an alternate embodiment, the proximal end of a tubular telescope housing member 102 can be connected to a handle member 108, and the distal end of the circumferentially smallest member of a plurality of tubular telescoping members 106 can be connected to a substantially tubular tine assembly housing member 104.

A tubular telescope housing member 102 can have a circular, square, or triangular cross section, or any other known and/or convenient geometry. In one embodiment, a tubular telescope housing member 102 can be made of injection-molded plastic. In alternate embodiments, a tubular telescope housing member 102 can be made of polymer, metal, or any other known and/or convenient material.

A plurality of tubular telescoping members 106 can have circular, square, or triangular cross sections, or any other known and/or convenient geometry. The geometry of a plurality of tubular telescoping members 106 can be the same as or different from the geometry of a tubular telescope housing member 102. In one embodiment, a plurality of tubular telescoping members 106 can be made of injection-molded plastic. In alternate embodiments, a plurality of tubular telescoping members 106 can be made of polymer, metal, or any other known and/or convenient material and/or combination of convenient materials.

Figure 2:
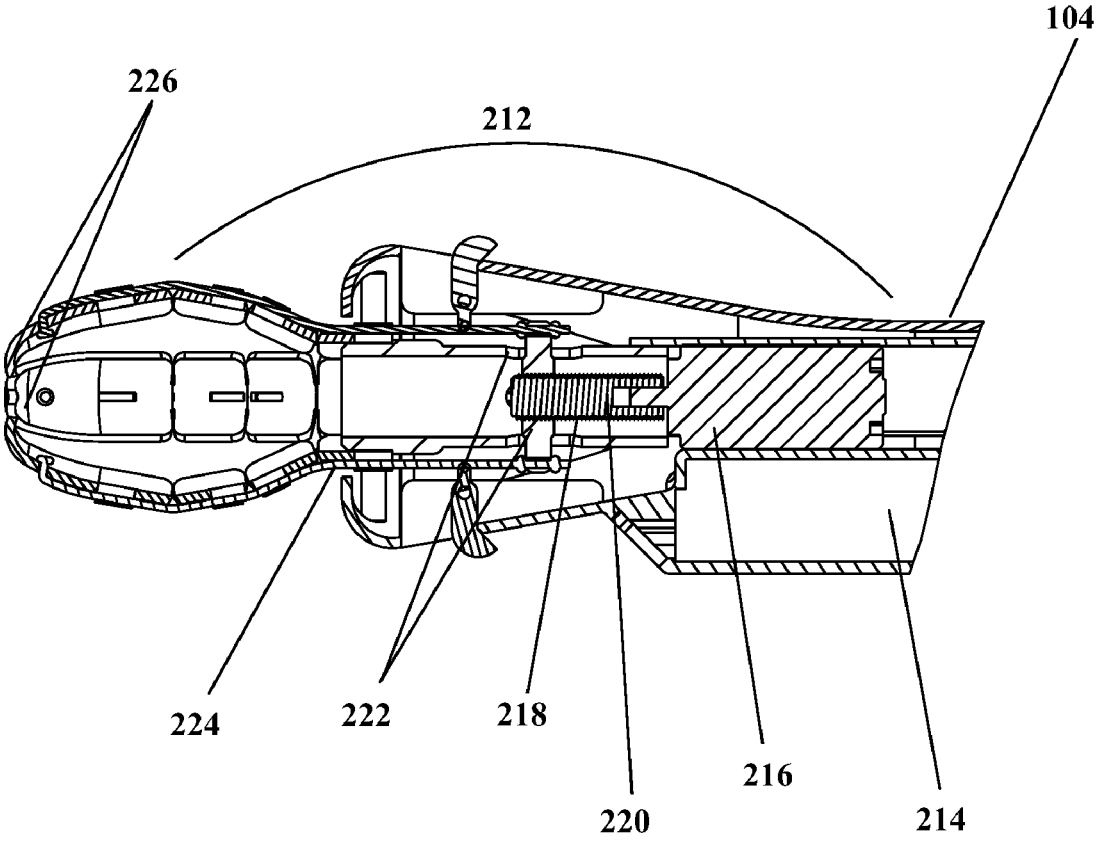
FIG. 2 depicts a perspective view of a cross-section of the present device.

As depicted in FIG. 2, a substantially tubular tine assembly housing member 104 can house a tine drive assembly 212 comprising several components. A first DC motor 214 can be housed within a substantially tubular tine assembly housing member 104 and located near the proximal end of said housing member 104. Said first DC motor 214 can have a torque arm 216 located at its distal end. An acme screw 218 can be an externally threaded cylindrical member. A torque arm 216 of a first DC motor 214 can be operatively coupled with the proximal end of an acme screw 218. An internally threaded nut 220 can be operatively coupled with the distal end of an acme screw 218. An acme screw 218 can translate the rotational motion of a first DC motor 214 into the linear motion of an internally threaded nut along the length of said acme screw 218.

An internally threaded nut 220 can also have a plurality of engagement arms 222 extending radially outward from its central axis. A plurality of engagement arms 222 can be coupled with at least one proximal end of one or more tine control elements 224. A substantial portion of each of one or more tine control elements 224 can each be coupled with a plurality of tines 226, located at the distal end of the present device 100.

One or more of the tine control elements 224 can be cables, semi-rigid metal, flexible polymer, or any other known and/or convenient flexible or semi-flexible material, or any known and/or convenient combination of materials along the length of said plurality of tine control elements.

Figure 2A:
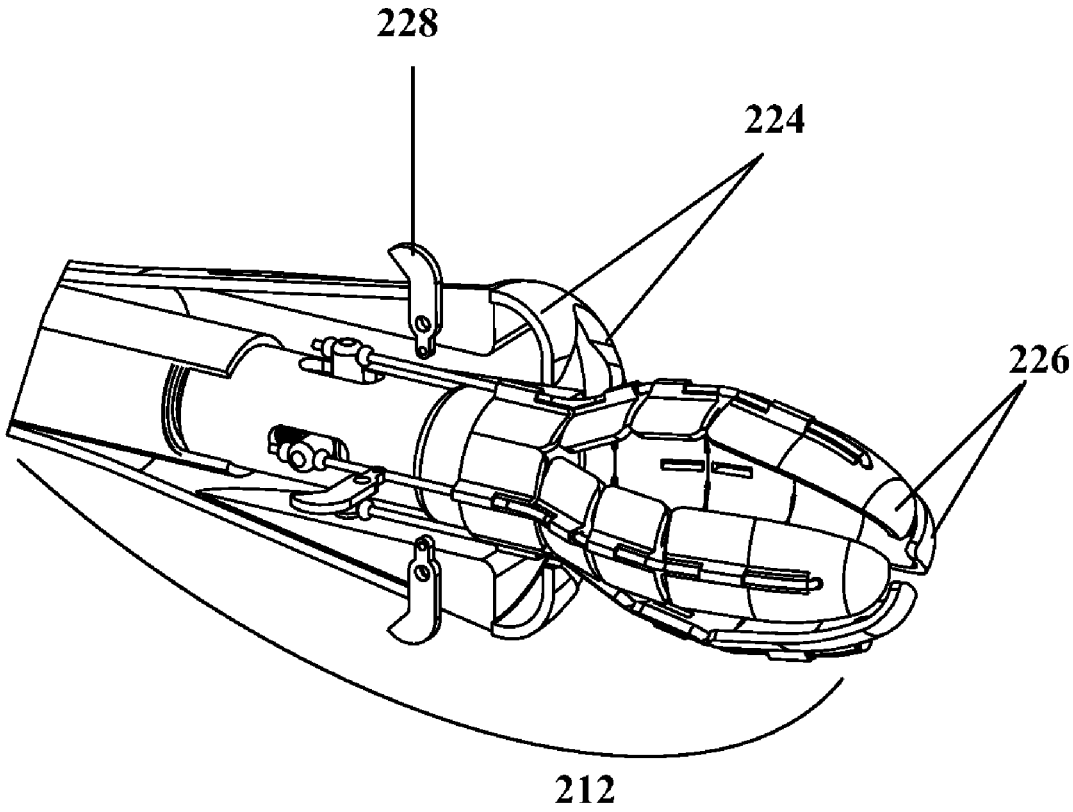
FIG. 2A depicts a perspective view of the inner components of the present device.

Each of a plurality of tines 226 can be substantially flexible and can be composed of a single piece of material or, alternatively, of several joined segments. Living hinges can be used to segment each of a plurality of tines 226, whereby the process of injection-molding can create a thin, plastic hinge between two pieces of rigid plastic, allowing them to bend along the line of the hinge. As shown in FIG. 2A, in one embodiment a plurality of tines can be comprised of an injection-molded polyolefin plastic material to provide segments joined by living hinges. In other embodiments, a plurality of tines 226 can be comprised of other plastics, polymers, metals or any other known and/or convenient material, and/or combination of desired and/or convenient materials. The material of the plurality of tines 226 need not itself be flexible, however each of a plurality of tines 226 can be constructed so as to be able to bend and collectively mimic the grabbing motion of a human hand.

In one embodiment, as shown in FIG. 2. one or more tine control elements 224 can be coupled with a plurality of tines 226 on at least one point on each segment of a plurality of tines 226. In alternative embodiments, one or more tine control elements 224 can be coupled with a plurality of tines 226 in any other known and/or convenient fashion so as to facilitate the bending of each of a plurality of tines 226 when desired.

As shown in FIG. 2A, in one embodiment a plurality of tines 226 can be biased to a naturally contracted state, wherein the living hinges on each tine can be bent such that the central portion of each tine can be curved away from the central axis of the present device 100. In such an embodiment, one or more tine control elements 224 can apply tension to the plurality of tines 226 in order to extend said plurality of tines 226 radially outward relative to the central axis of the present device 100. In an alternate embodiment, a plurality of tines 226 can be biased to a naturally extended state, wherein one or more tine control elements 224 can apply a force to the plurality of tines 224 in order to keep them contracted.

The above-described tine drive assembly 212 can be completely or substantially hidden within a substantially tubular tine assembly housing member 104 when the present device 100 is not in use, and can be pushed out of or retracted into a substantially tubular tine assembly housing member 104 via the second controlling mechanism 110 located on a handle member 108.

Figure 1A:
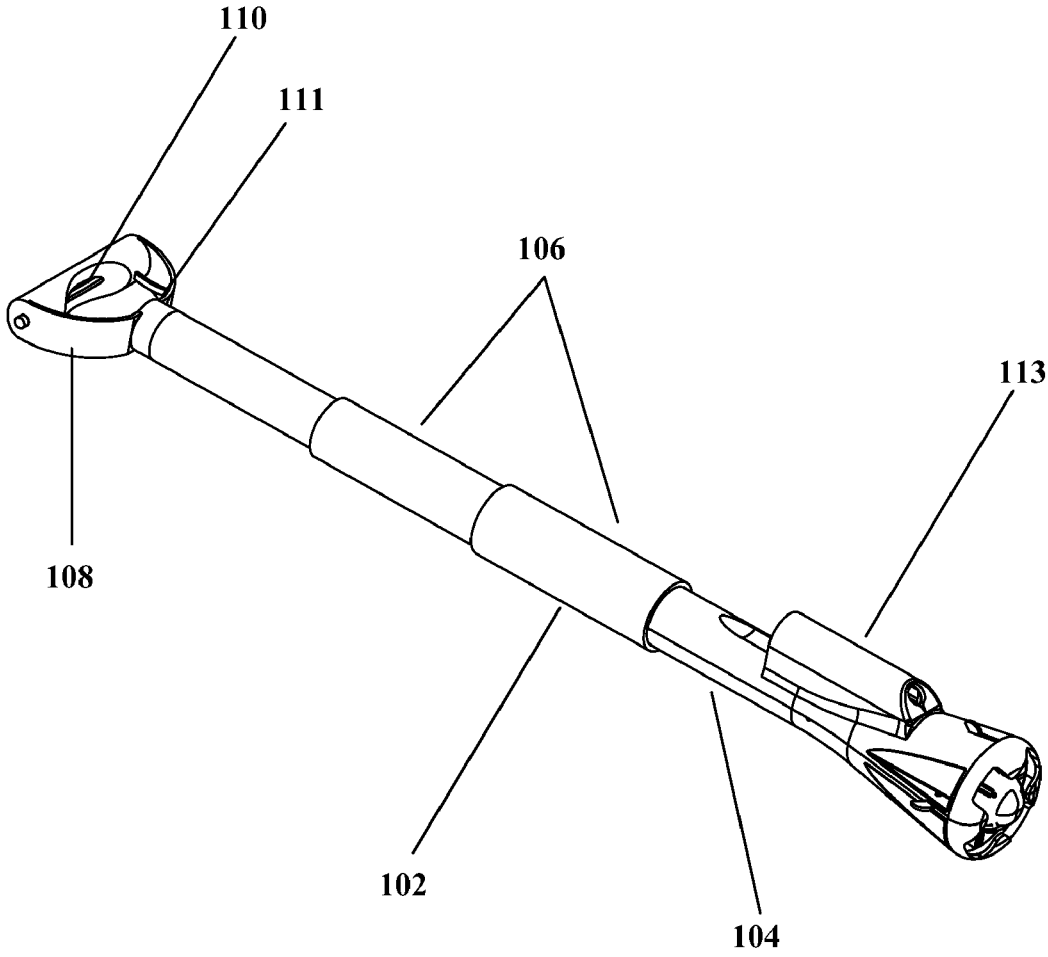
FIG. 1A depicts a perspective view of the present device in a partially extended position.

As shown in FIG. 1A, a handle member 108 can be coupled to the proximal end of the circumferentially smallest member of a plurality of tubular telescoping members 106. In an alternate embodiment, the proximal end of a tubular telescope housing member 102 can be connected to a handle member 108, and the distal end of the circumferentially smallest member of a plurality of tubular telescoping members 106 can be connected to a substantially tubular tine assembly housing member 104.

Figure 3:
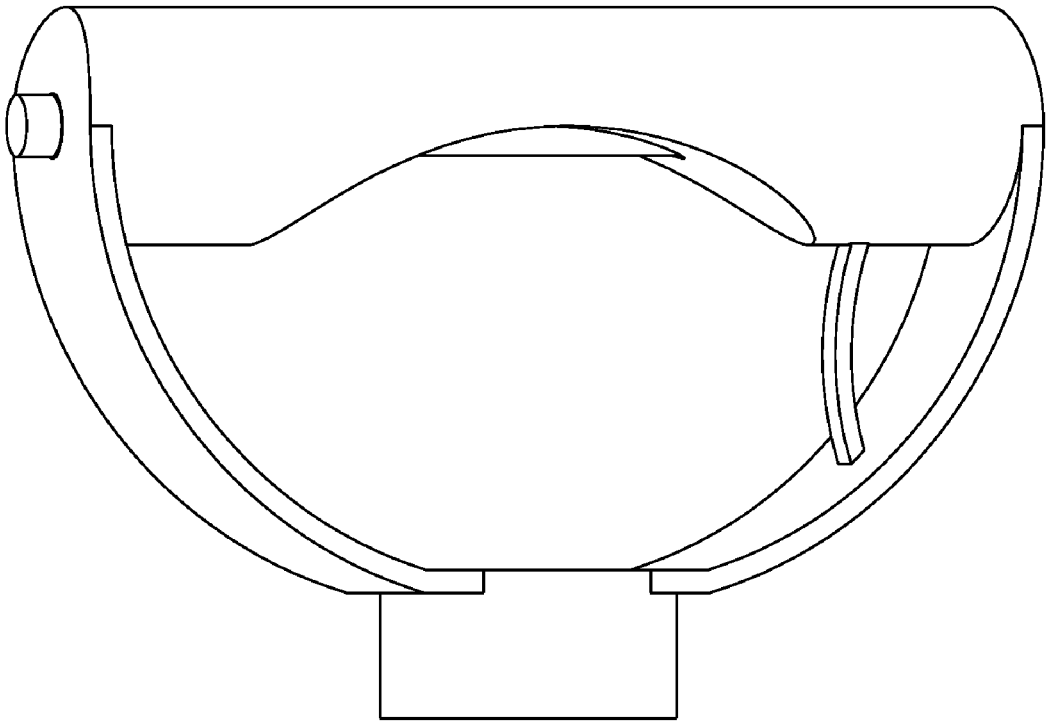
FIG. 3 depicts one embodiment of a handle member for the present device.
Figure 3A:
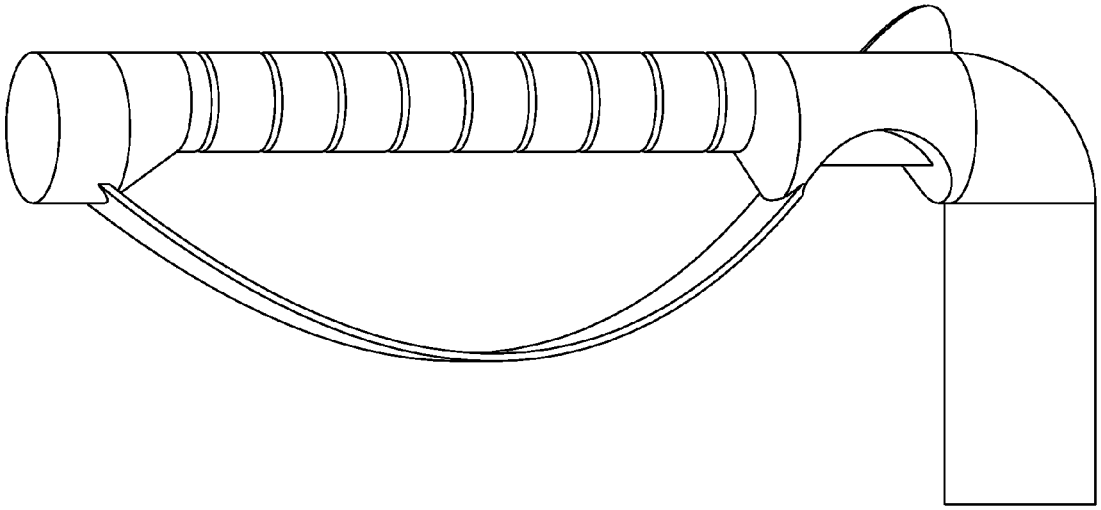
FIG. 3A depicts another embodiment of a handle member for the present device.
Figure 3B:
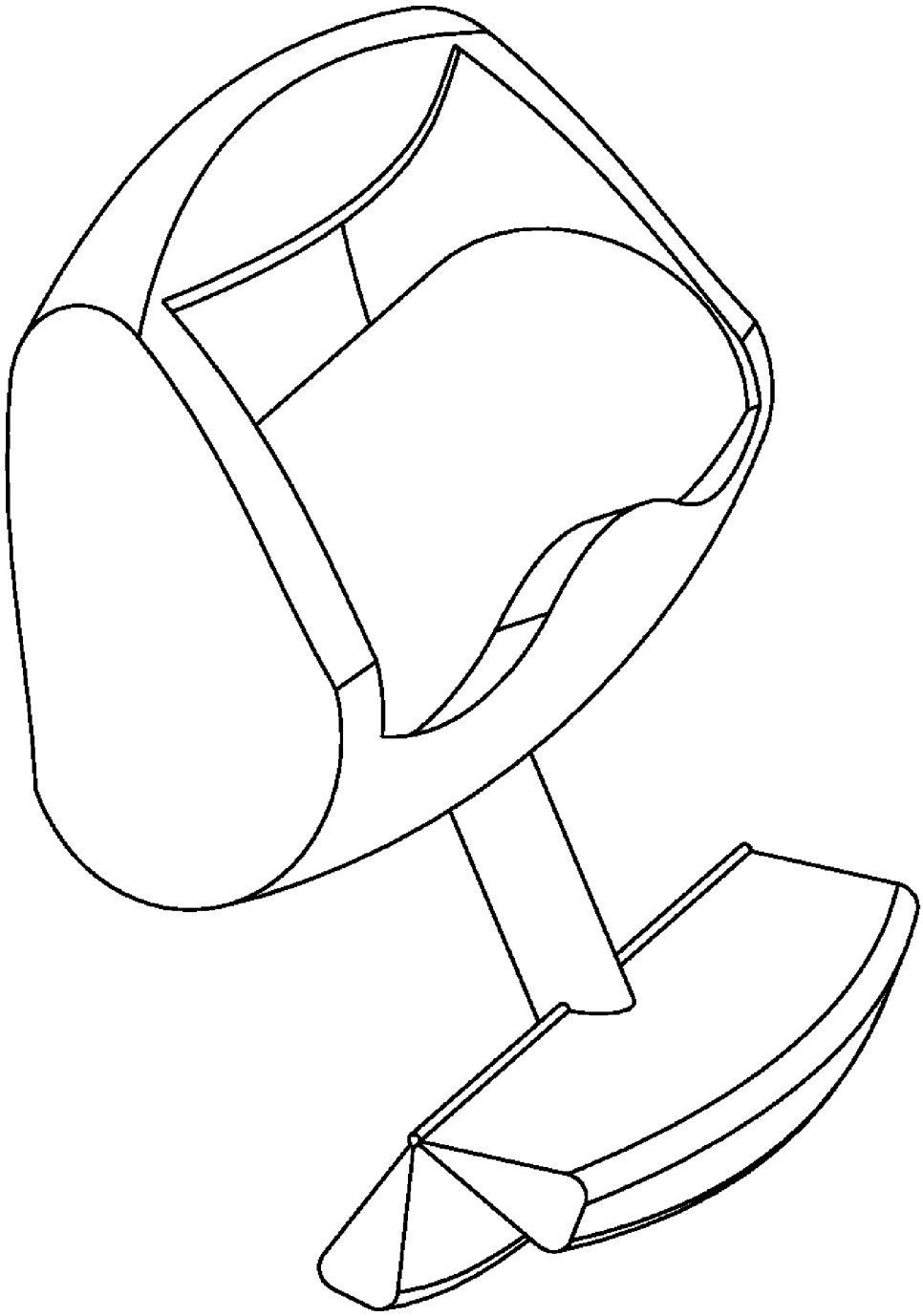
FIG. 3B depicts yet another embodiment of a handle member for the present device.

A handle member 108 can have a closed loop configuration, as shown in FIG. 1, or can have any other known and/or convenient configuration which can allow a user to easily grip the proximal end of the present device 100, as shown in FIGS. 3-3B. A handle member 108 can be made of plastic, polymer, metal, wood, or any other known and/or convenient material or combination of materials.

A handle member 108 can have a plurality of controlling mechanisms 110 that can control various operations of the present device 100. A first controlling mechanism 110 can control the release of a damped spring 428 housed within a plurality of tubular telescoping members 106 (see FIG. 4). A second controlling member 110 can control the movement of a tine drive assembly 212 in and out of a substantially tubular tine assembly housing member 104 (see FIG. 2). A third controlling mechanism 110 can extend a plurality of tines 226 radially outward (see FIG. 5). First, second and third controlling mechanisms can be separate switches, buttons, or any other known and/or convenient actuating members on a handle 108. Alternatively, first, second and third controlling mechanisms can be operated by the same multi-state switch, button, or any other known and/or convenient actuating member which has a plurality of operating states.

Figure 4:
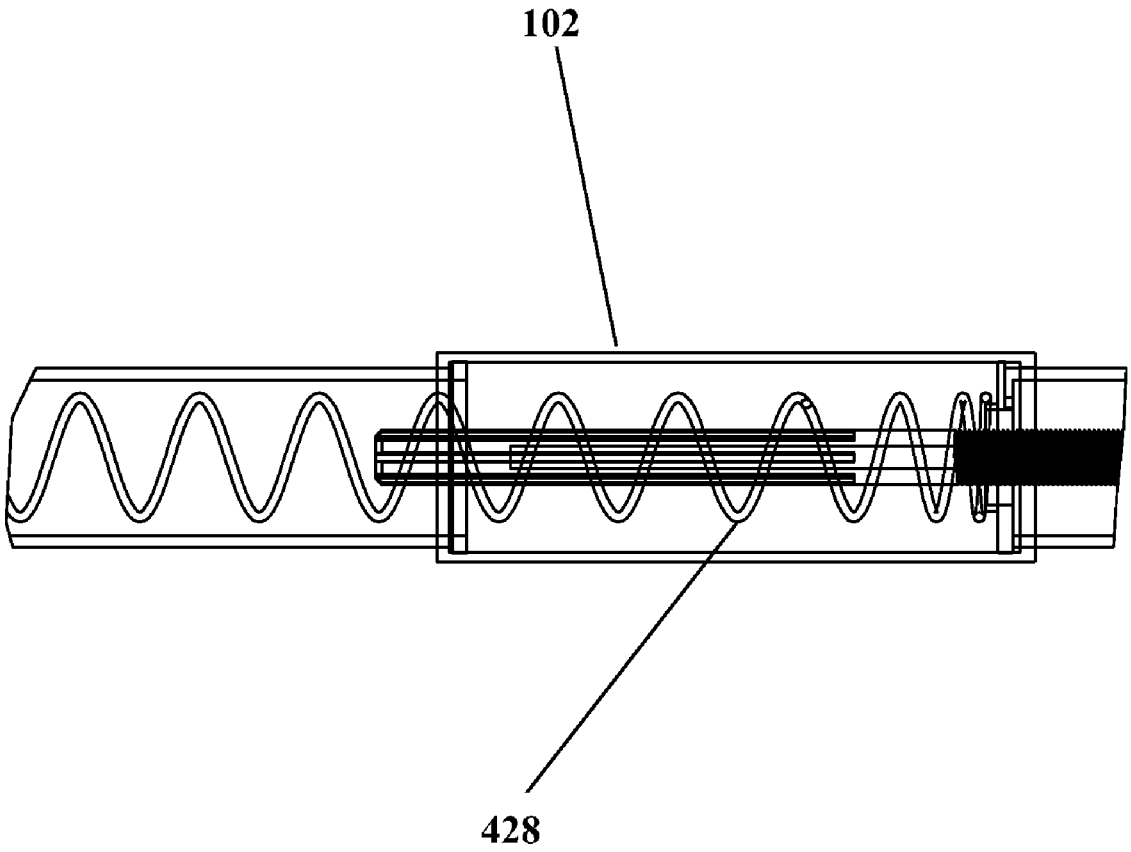
FIG. 4 depicts an internal view of a telescoping portion of the present device.

As shown in FIGS. 1-1A, a plurality of tubular telescoping members 106 can be retracted when the present device 100 is not in use, or can be extended in preparation for or during use of the present device 100. Extension of a plurality of tubular telescoping members 106 can be facilitated via a damped spring 428, as shown in FIG. 4. A spring 428 can be biased to an extended state and can be substantially similar in length to that of a plurality of tubular telescoping members 106 when in their fully expanded position. The proximal end of said spring 428 can be operatively coupled with a handle member 108, while the distal end of said spring 428 can be operatively coupled with the distal end of a tubular telescope housing member 102. In alternative embodiments, extension of a plurality of tubular telescoping members 106 can be facilitated via any other known and/or convenient mechanism.

Retraction of a plurality of tubular telescoping members 106 can be facilitated via mechanical means coupled with a second DC motor. In one embodiment, a second DC motor 111 can be located in a handle member 108 (see FIG. 1A). In other embodiments, a second DC motor 111 can be positioned at any convenient point along the circumferentially smallest member of a plurality of tubular telescoping members 106, or can be housed within a tubular telescope housing member 102. In one embodiment, a cable can be housed within a plurality of tubular telescoping members 106 and a motor driven clutch and reel mechanism can retract said cable in order to retract said plurality of tubular telescoping members 106. In other embodiments, any other known and/or convenient mechanism for retraction of a plurality of tubular telescoping members 106 can be employed.

Figure 2B:
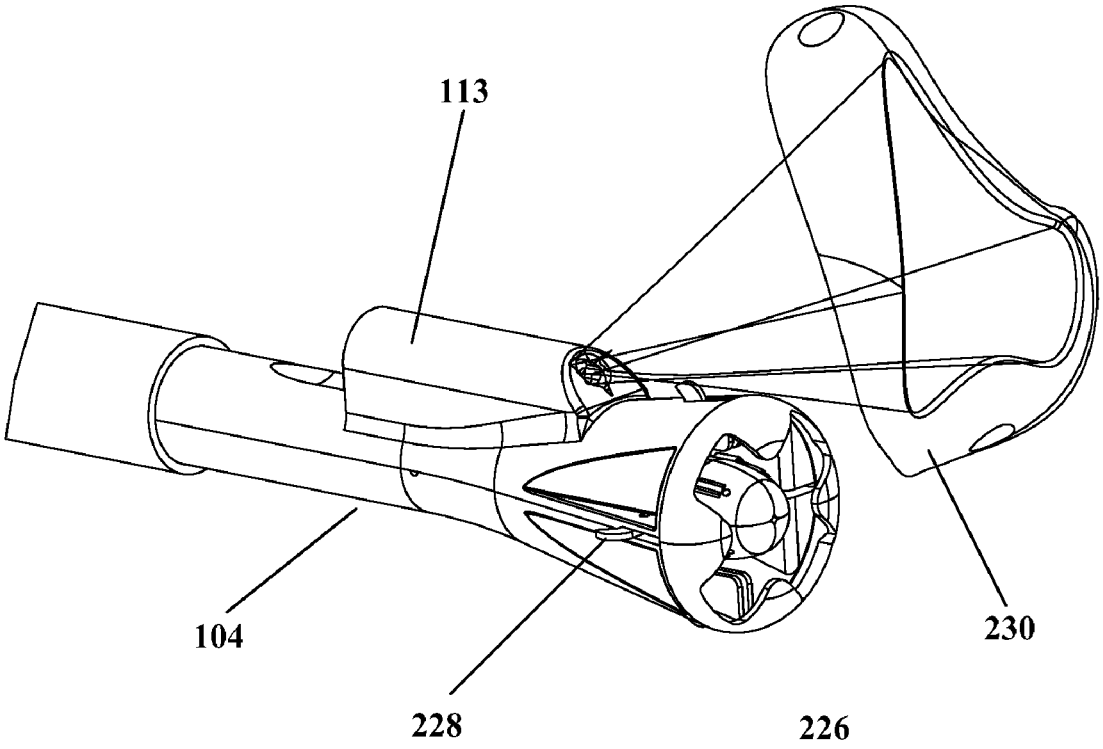
FIG. 2B depicts a perspective view of a disposable receptacle being removed from a raised receptacle compartment.

As shown in FIG. 2A, a plurality of receptacle retention members 228 can be located substantially close to the distal end of a substantially tubular tine assembly housing member 104 for use with disposable receptacles 230 (see FIG. 2B). In an open state, each of a plurality of receptacle retention members 228 can be extended radially outward from the central axis of the present device such that a portion of said retention members 228 protrudes from opening in the exterior surface of a substantially tubular tine assembly housing member 104. In a closed state, each of a plurality of receptacle retention members 228 can be retracted within said assembly housing member 104.

As shown in FIG. 2A, in one embodiment a plurality of receptacle retention members 228 can be operatively coupled with the interior of the distal end of a substantially tubular tine assembly housing member 104 and separate from a tine drive assembly 212. In such an embodiment, helical coil springs can be embedded within each of a plurality of receptacle retention members 228 causing each member to be naturally bias to an open state. Thus, a force would need to be applied against this bias in order to retract said retention members 228 into their closed state.

As shown in FIG. 2, in an alternate embodiment each of a plurality of receptacle retention members 228 can be operatively coupled with each of one or more tine control elements 224, such that the movement of said tine control elements 224 controls the movement of said retention members 228. In such an embodiment, a tine drive assembly 212 can have at least three stages of motion that can affect the state of the plurality of receptacle retention members 228. A plurality of receptacle retention members 228 can be in a closed state when a tine drive assembly 212 is fully retracted within a substantially tubular tine assembly housing member 104. As said tine drive assembly 212 is pushed out of the distal end of said assembly housing member 104, a plurality of receptacle retention members 228 can extend outward to an open state. When said tine drive assembly 212 is ready to release captured material, it can extend even further from the distal end of a substantially tubular tine assembly housing member 104, allowing a plurality of receptacle retention members 228 to once again retract into said housing member 104.

A plurality of receptacle retention members 228 can be hooks, as shown in FIG. 2A, or can be any other known and/or convenient device for retaining and releasing disposable receptacles. A plurality of receptacle retention members 228 can be plastic, metal, polymer, or any other known and/or convenient material.

As depicted in FIG. 2B, a substantially tubular tine assembly housing member 104 can have a raised receptacle compartment 113 connected to a portion of its surface. Said raised receptacle compartment 113 can be used in conjunction with a prepackaged receptacle cartridge. In the absence of said cartridge, a raised receptacle compartment 113 can be used to house loose disposable receptacles, such as standard plastic grocery bags.

In an alternative embodiment, a raised receptacle compartment can be removable from the present device 100. In yet an alternative embodiment, an automatic receptacle distribution system can be positioned in direct alignment with the present device 100, rather than on the side of it, thereby reducing or eliminating the need for user handling of the bags.

In use, a user can first extract a disposable receptacle 230 from a raised receptacle compartment 113, as shown in FIG. 2B. A user can then place the handles or loops of a disposable receptacle 230 over a plurality of receptacle retention members 228, such that the closed end of the disposable receptacle can be positioned away from the distal end of the present device 100 and a disposable receptacle 230 can be temporarily retained on the present device 100.

Figure 2C:
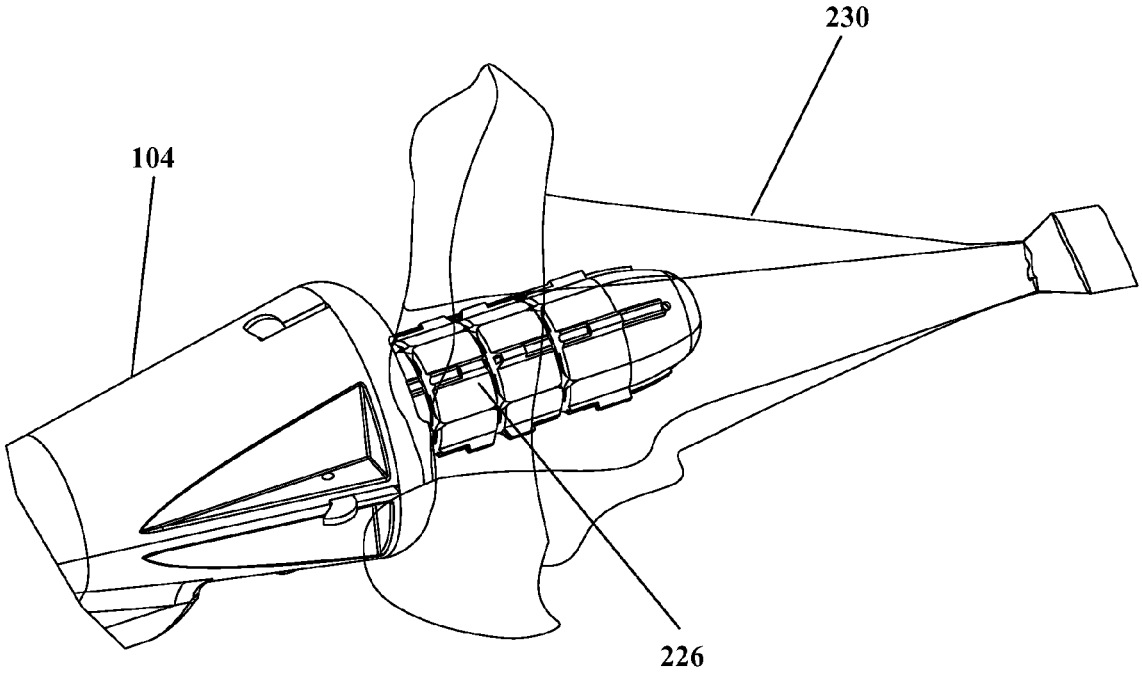
FIG. 2C depicts one embodiment of a plurality of tines proximate to the closed end of a disposable receptacle.

A user can subsequently extend a plurality of tubular telescoping members 106 via a first controlling mechanism 110 on a handle member 108, which can release a damped spring 428 housed within said plurality of tubular telescoping members 106 and can cause them to reach a fully expanded position. A second controlling mechanism 110 on a handle member 108 can control the movement of a tine drive assembly 212 in and out of a substantially tubular tine assembly housing member 104. In said alternate embodiment, a user can activate a first controlling mechanism 110 prior to activating a second controlling mechanism 110, or vice versa, or a user may deem it unnecessary to activate a first controlling mechanism 110 at all (thus, keeping the plurality of tubular telescoping members 106 in a nested position). In either embodiment, before any further operation of the present device 100 can commence, a tine drive assembly 212 must be pushed out of the distal end of a substantially tubular tine assembly housing member 104 such that a plurality of tines 226 can be substantially exposed and close to or in contact with the closed end of a disposable receptacle 230 (see FIG. 2C).

Figure 5:
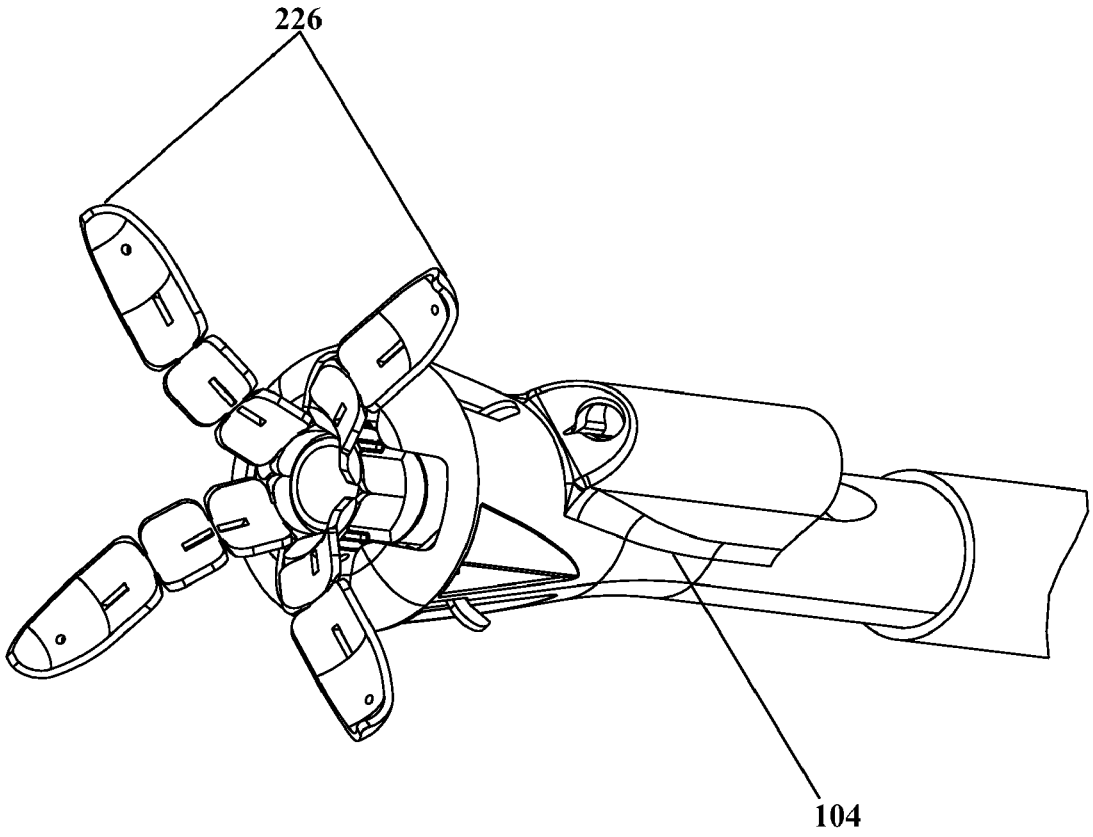
FIG. 5 depicts an in-use, extended tine configuration of the present device.

Once a plurality of tines 226 are substantially exposed, a user can activate a first DC motor 214 via a third controlling mechanism 110 on a handle 108 in order to extend said tines 226 radially outward and prepare them to accept fecal matter or other material. Once a first DC motor 214 is activated, its torque arm 216 can rotate an acme screw 218 thereby guiding an internally threaded nut 220 further toward the proximal end of the acme screw 218. As an internally threaded nut 220 moves along the length of an acme screw 218, a plurality of tine control elements 224 (which can be attached to the internally threaded nut 220 via a plurality of engagement arms 222) can move toward the proximal end of the present device 100. Such movement of said tine control elements 224 can put tension on a plurality of tines 226 and cause them to extend radially outward relative to the central axis of the present device 100. At this point, the tines 226 can be expanded and ready to accept fecal material or other matter, as shown in FIG. 5.

In one embodiment, when a first DC motor 214 reaches a predetermined torque level it can reverse direction, causing an internally threaded nut 220 to reverse the direction of its movement along an acme screw 218 and can thereby allow a plurality of tines 226 to contract to their natural state. In said embodiment, a user can have a predetermined amount of time in which to place the tines 226 over the material to be picked up before a plurality of tines 226 contract again.

In an alternate embodiment, when a first DC motor 214 reaches a predetermined torque level, it can cease motion until a user re-engages it. Once a user re-engages a first DC motor 214, it can automatically reverse direction and can cause the internally threaded nut 220 to reverse the direction of its movement along the length of the acme screw 218, thereby allowing a plurality of tines 226 to contract to their natural state. In said alternate embodiment, a user can have control over the timing of the contracted and expanded states of a plurality of tines 226.

Once a plurality of tines 226 is expanded and ready to accept fecal material or other matter, a user can place the present device 100 over said material and said tines 226 can re-contract, enclosing said material and the closed end of a disposable receptacle within its grip. Re-contraction of said tines 226 can be controlled by either a user or a pre-programmed first DC motor 214, as described in the previous paragraph. At this point, fecal material or other matter can be contained within the grip of a plurality of tines 226, and a user can move the present device 100 away from the surface from which said material was picked up.

In order to dispose of collected fecal material or other matter, a user can position the present device 100 over a trash receptacle and once again activate a third controlling mechanism 110 on a handle 108 in order to re-extend a plurality of tines 226. At the same time, a plurality of receptacle retention members 228 can be retracted into a substantially tubular tine assembly housing member 104, thereby releasing the handles or loops of a disposable receptacle 230. With these simultaneous actions, a disposable receptacle and its contents can be released into a trash receptacle for disposal.

When a user desires to store the present device or compact it for easier portability, a user can activate mechanical means for retracting a plurality of tubular telescoping members 106. A user can also activate a second controlling mechanism 110 on a handle 108 in order to retract the tine drive assembly 212 into a substantially tubular tine assembly housing member 104.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A waste removal device, comprising:

an extendable elongated tubular member having a proximal end and a distal end;

a handle member being coupled with said proximal end of said extendable elongated tubular member;

said distal end of said extendable elongated tubular member being coupled with a plurality of tines;

said distal end of said extendable elongated tubular member also being coupled with a tine drive assembly;

said tine drive assembly being coupled with said plurality of tines;

an electrical drive coupled with said tine drive assembly wherein said electrical drive controls said tine drive assembly; and a substantially tubular tine drive assembly housing member being coupled with said distal end of said extendable elongated tubular member, wherein said plurality of tines are temporarily housed within said substantially tubular tine drive assembly housing member;

wherein said tine drive assembly further comprises a first DC motor located within said substantially tubular tine drive assembly housing member;

the distal end of said first DC motor having a torque arm;

an externally threaded cylindrical member coupled with the proximal end of said torque arm;

an internally threaded nut coupled with the distal end of said externally threaded cylindrical member; and said externally threaded cylindrical member having a plurality of engagement arms extending radially outward from its central axis.

2. The device of claim 1, wherein said externally threaded cylindrical member can translate the rotational motion of said first DC motor into the linear motion of said internally threaded nut along the length of said externally threaded cylindrical member.

3. The device of claim 1, further comprising at least one tine control element being coupled with at least one of said plurality of tines, the proximal end of said at least one tine control element being coupled with at least one of said plurality of engagement arms.

4. The device of claim 3, wherein said at least one tine control element is metal.

5. The device of claim 1, wherein one or more of said plurality of tines has a plurality of living hinges.

6. The device of claim 1, wherein at least one of said plurality of tines is biased to a naturally contracted state.

7. The device of claim 1, further comprising a second controlling mechanism that controls the movement of said tine drive assembly in and out of said substantially tubular tine drive assembly housing member.

8. The device of claim 1, further comprising a third controlling mechanism that controls the extension of said plurality of tines radially outward relative to the central axis of said substantially tubular tine drive assembly housing member.

9. The device of claim 1, further comprising a raised receptacle compartment coupled with a portion of the exterior surface of said substantially tubular tine drive assembly housing member.

10. A waste removal device, comprising:

an extendable elongated tubular member having a proximal end and a distal end;

a handle member being coupled with said proximal end of said extendable elongated tubular member;

said distal end of said extendable elongated tubular member being coupled with a plurality of tines;

said distal end of said extendable elongated tubular member also being coupled with a tine drive assembly;

said tine drive assembly being coupled with said plurality of tines;

an electrical drive coupled with said tine drive assembly wherein said electrical drive controls said tine drive assembly;

a first controlling mechanism located within said handle member;

a spring located within said extendable elongated tubular member, said spring being biased to a naturally extended state;

the proximal end of said spring being coupled with said handle member;

the distal end of said spring being coupled with said distal end of said extendable elongated tubular member;

said first controlling mechanism controlling the release of said spring; and said extendable elongated tubular member being extended when said spring is released.

11. A waste removal device, comprising:

an extendable elongated tubular member having a proximal end and a distal end;

a handle member being coupled with said proximal end of said extendable elongated tubular member;

said distal end of said extendable elongated tubular member being coupled with a plurality of tines;

said distal end of said extendable elongated tubular member also being coupled with a tine drive assembly;

said tine drive assembly being coupled with said plurality of tines;

an electrical drive coupled with said tine drive assembly wherein said electrical drive controls said tine drive assembly;

a substantially tubular tine drive assembly housing member being coupled with said distal end of said extendable elongated tubular member;

said plurality of tines being temporarily housed within said substantially tubular tine drive assembly housing member;

a plurality of receptacle retention members located proximate to the distal end of said substantially tubular tine drive assembly housing member, said plurality of receptacle retention members being coupled with the interior of said distal end of said substantially tubular tine drive assembly housing member;

said plurality of receptacle retention members extending radially outward from the central axis of said substantially tubular tine drive assembly housing member when in an open configuration;

at least one aperture in the exterior surface of said substantially tubular tine drive assembly housing member, said plurality of receptacle retention members protruding from said at least one aperture; and said plurality of receptacle retention members being coupled with the distal end of said tine drive assembly.

12. The device of claim 11, wherein said plurality of receptacle retention members are hooks.

* * * * *

UNITED STATES PATENT AND TRADEMARK OFFICE

CERTIFICATE OF CORRECTION

PATENT NO. : 8,066,310 B2
APPLICATION NO. : 12/244749
DATED : November 29, 2011
INVENTOR(S) : O'Hare et al.

It is certified that error appears in the above-identified patent and that said Letters Patent is hereby corrected as shown below:

Title Page, Item (76) Inventor is corrected to read:
--(75) Inventors: Michael J. O'Hare, Nutley, NJ (US); Edward J. Laganis, Hoboken, NJ (US); Anthony La Rosa, Wharton, NJ (US)--.

Signed and Sealed this
Twenty-third Day of June, 2015

Michelle K. Lee

Michelle K. Lee
*Director of the United States Patent and Trademark Office*